United States Patent [19]

Little et al.

[11] 3,966,290

[45] June 29, 1976

[54] POLARIZED CONNECTOR

[75] Inventors: David Murray Little, Harrisburg; Gary Lee Zimmerman, Shermansdale, both of Pa.

[73] Assignee: AMP Incorporated, Harrisburg, Pa.

[22] Filed: July 2, 1975

[21] Appl. No.: 592,428

Related U.S. Application Data

[63] Continuation of Ser. No. 478,206, June 11, 1974.

[52] U.S. Cl. ..... 339/17 LC; 339/17 LM; 339/66 M; 339/176 MP; 339/184 M

[51] Int. Cl.[2] ..... H01R 13/64; H05R 1/06

[58] Field of Search ..... 339/17 L, 17 M, 17 LC, 339/17 LM, 64 M, 66 M, 75 M, 176 MP, 184 M, 185

[56] References Cited

UNITED STATES PATENTS

| | | | |
|---|---|---|---|
| 2,864,977 | 12/1958 | Witt et al. | 339/17 LM X |
| 3,320,572 | 5/1967 | Schwartz | 339/64 M X |
| 3,636,503 | 1/1972 | Bernutz et al. | 339/17 LC X |
| 3,697,926 | 10/1972 | Krafthefer | 339/17 L |
| 3,876,274 | 4/1975 | Ruehlemann et al. | 339/64 M |

*Primary Examiner*—Roy Lake
*Assistant Examiner*—E. F. Desmond
*Attorney, Agent, or Firm*—Gerald K. Kita

[57] ABSTRACT

Two dielectric housings are mounted respectively to printed circuit boards. When the housings are mated together the two printed circuit boards will be connected electrically together with pins on the one board within receptacles of the other board. One of the housings is connected to an edge margin of the board and is provided with a chamfered lip which covers the edge of the board and provides a polarizing structure to permit interconnection between the two housings when oriented as desired.

2 Claims, 4 Drawing Figures

POLARIZED CONNECTOR

This is a continuation, of application Serial No. 478,206, filed June 11, 1974.

There has been a long-existing need in the prior art for apparatus capable of connecting printed circuit boards together at right angles. Such a configuration is generally referred to as a mother board, daughter board arrangement. Generally the daughter board is provided with electrical terminals in the form of receptacles which are pluggably received over conducting pins or posts mounted in the mother board. A dielectric housing on the mother board protects the projecting pin and also provides a receptacle for receiving the daughter board. To ensure correct positioning of the daughter board, polarization is provided on the mother board receptacle. This is usually in the form of non-symmetrical geometry of the mother board receptacle mating with complementary geometry provided on the daughter board. In the present invention a dielectric housing is provided also on the daughter board for containing the electrical receptacles mounted thereon. The housing is chamfered for ease of insertion within a funnel entry opening of the mother board receptacle. The housing further includes a chamfered lip portion which overlies an edge of the daughter board protecting it from damage and providing a flush surface on the daughter board housing for ease in entry within the mother board receptacle. The post or pins within the mother board receptacle are offset from a symmetrical arrangement in order to receive a complementary arrangement of receptacles within the daughter board housing.

OBJECTS OF THE INVENTION

It is an object of the present invention to provide a means for assuring polarized alignment between a mother board and a daughter board interconnected by mating electrical posts and receptacles.

Another object of the present invention is to provide a daughter board with a dielectric housing which protects a leading edge of the daughter board and which provides a structure for polarizing the daughter board for correct receipt within a housing mounted on a mother board.

Other objects and many attendant advantages of the present invention will become apparent upon perusal of the following detailed description taken in conjunction with the accompanying drawings.

DETAILED DESCRIPTION OF THE PREFERRED EMBODIMENTS

Figure 1:
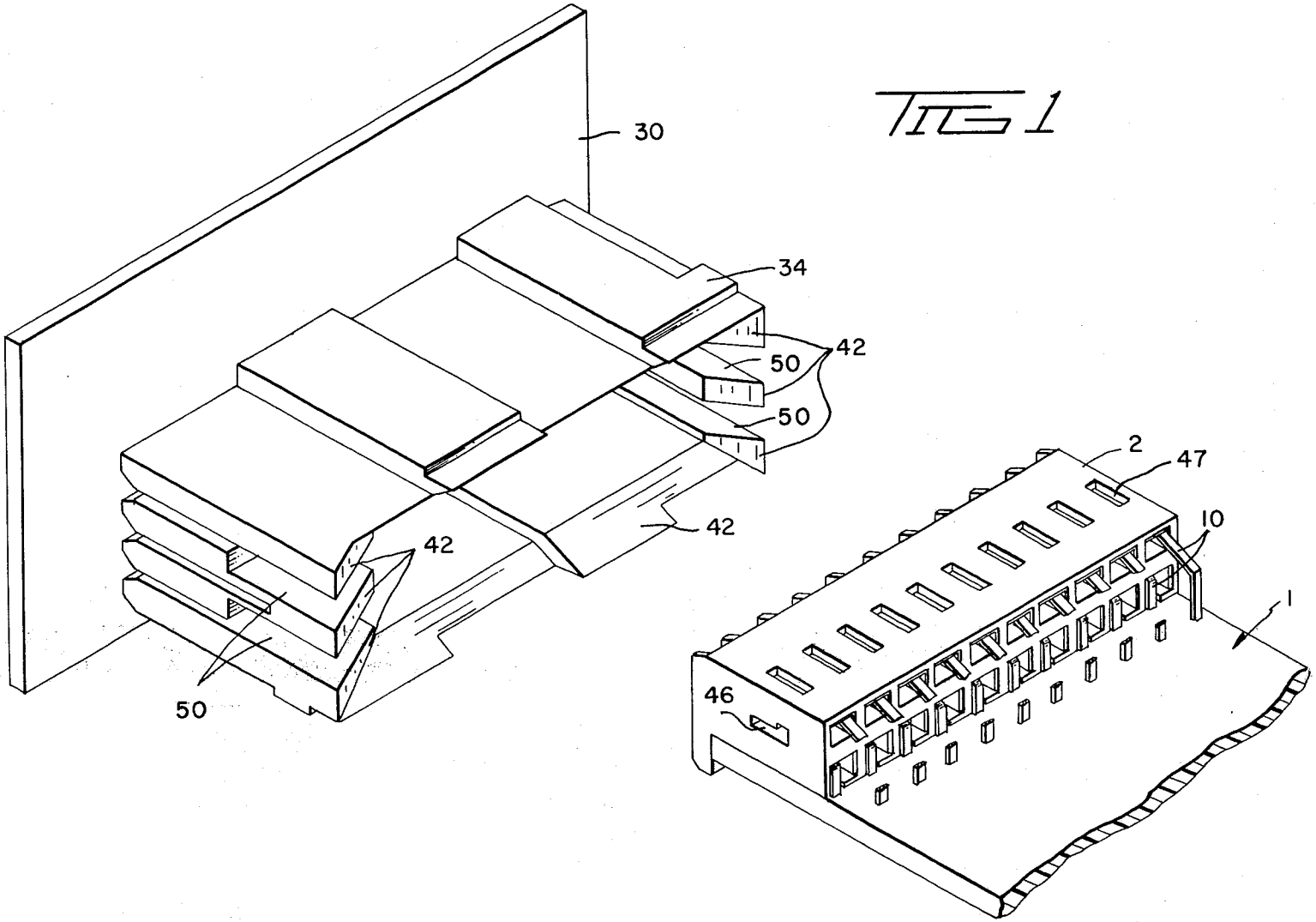
FIG. 1 is an enlarged fragmentary perspective of a preferred embodiment according to the present invention with parts illustrated in exploded configuration for clarity.
Figure 2:
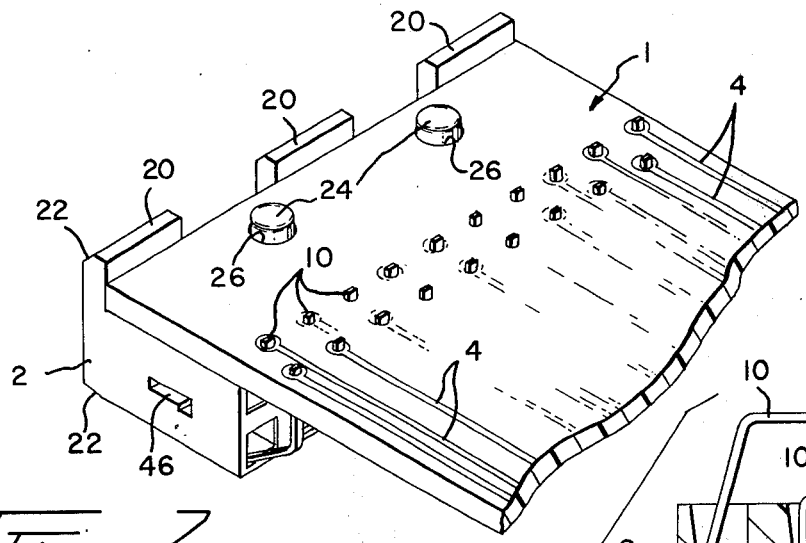
FIG. 2 is an enlarged fragmentary perspective illustrating a daughter board provided thereon with a housing containing electrical receptacles electrically mounted to circuit paths on the daughter board.
Figure 3:
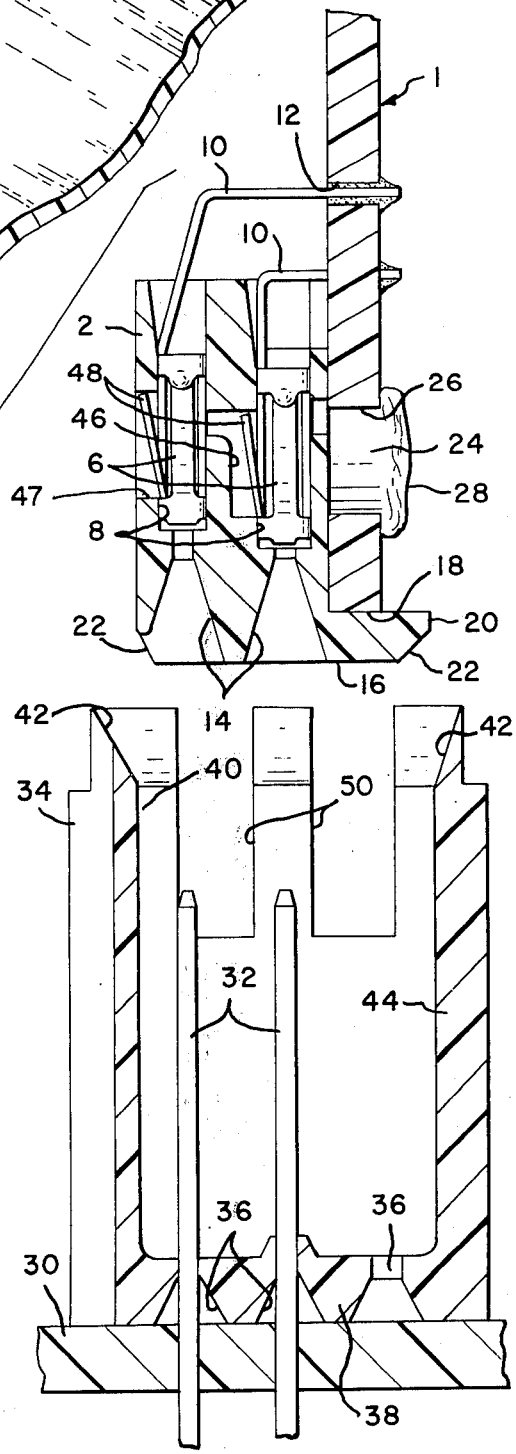
FIG. 3 is an enlarged fragmentary elevation with parts in section and exploded illustrating the details of the preferred embodiment of a mother board and daughter board.

With more particular reference to the drawings there is illustrated generally at 1 in FIGS. 1, 2, and 3, a daughter board having mounted thereon a dielectric housing 2. The board 1 includes a plurality of conducting circuit pads some of which are illustrated at 4. Electrical receptacles some of which are illustrated at 6 are provided within corresponding apertures 8 or cavities within the housing 2. Each of the receptacles 6 have electrically conducting tail portions 10 which project outwardly of the housing cavities and which are bent to project into corresponding apertures 12 of the board 1. As shown more particularly in FIG. 2 the tail portions 10 communicate with corresponding electrical paths 4. To ensure electrical conductivity the tail portions 10 are soldered to the paths 4. For convenience in routing of the paths 4, the tail portions 10 project outwardly from the cavities 8 of the housing 2 in staggered fashion and are connected to the board in two separate rows.

As shown the cavities 8 and 10 within the housing 2 are disposed in two separate rows parallel to the surface of the board 1. Each of the cavities 8 have a funnel entry or opening 14 through one end 16 of the housing 2. The edge 18 of the board is overlied by a lip portion 20 of the housing 2. As shown the lip portion 20 may be segmented. Alternatively the lip portion may be continuous if desired. The sharp edges of the end surface 16 are chamfered as shown at 22 for a purpose to be described. The housing 2 is mounted to the edge margin adjacent the edge 18 by a pair of projecting plastic rivets 24 in registration within corresponding apertures 26 of the board 1. The rivets 24 may be expanded with an enlarged head portion 28 as shown in FIG. 3 in order to permanently mount the housing 2 to the edge margin of the board 1.

Figure 4:
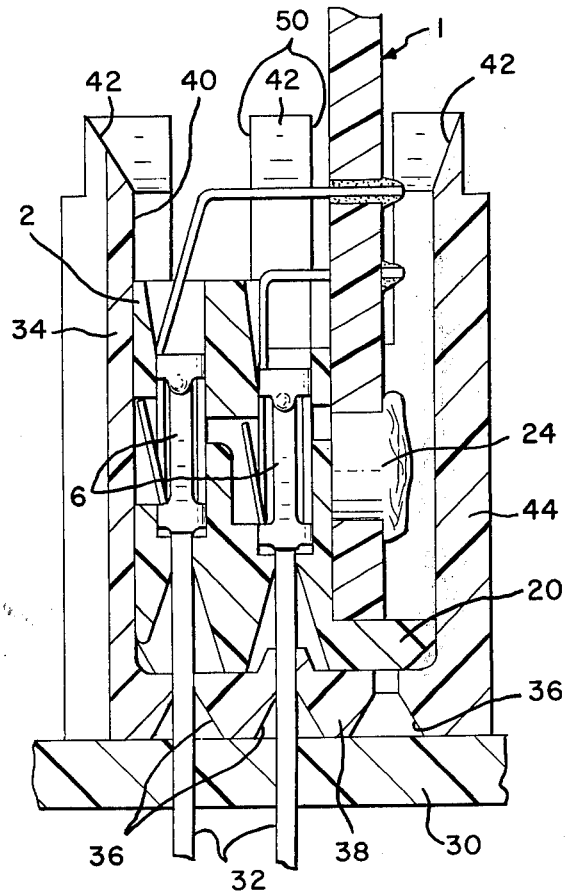
FIG. 4 is an enlarged fragmentary elevation in section illustrating the combination of the daughter board and its housing containing electrical receptacles which are in mating engagement with terminal posts contained within a housing mounted on a mother board.

Also shown in FIG. 3 taken in conjunction with FIGS. 1 and 4, a mother board 30 is provided with two rows of electrically conducting elongated posts or pins 32 which are mounted to the board 30 by press-fit connections within apertures of the board and which project interiorly of an enclosing dielectric housing 34. As shown the housing 34 includes three rows of apertures 36 through an end wall 38. The posts 32 occupy only two of the three rows of apertures 36 and therefore are arranged in rows offset within the interior of the housing 34 for complementary alignment with the funnel entry openings 14 of the housing 2 which are offset along the end surface 16. The housing 34 has an open end 40 the interior edge surfaces of which are chamfered as shown at 42 in order to provide a funnel entry for receipt therein of the externally chamfered end 16 of the housing 2. As shown in FIG. 4, when the daughter board 1 and the housing 2 thereof are received within the confines of the housing 34, the lip portion 20 engages against a sidewall of the housing as well as the end wall 38 of the housing 34 in order to maintain the housing 2 and the daughter board 1 in desired alignment within the housing 34. The apertures 14 of the housing 2 are offset along the end wall 16 of the housing, in order to align the receptacles 6 over the corresponding offset rows of posts or pins 32. The posts or pins are electrically received within the receptacles 6 when the daughter board 1 is correctly pluggably connected to the mother board 30 as shown in FIG. 4. As a further feature the housing 2 is provided with a slotted portion 46 extending through the housing to allow insertion of an extraction tool for deflecting the latch portion 48 of the receptacles 6 to allow their removal from the housing 2. The slotted portion extends transversely through the housing 2 and intersects each of the projecting latch portions 48 of a first row of receptacles 6. All of the latch portions can be deflected into the bodies of the receptacles by inserting an elongated tool through the slotted portion 46. This will allow removal of the row of receptacles from the housing 2.

The other row of receptacles 6 include their latch portions 48 projecting into a recess 47 which communicates with each of the cavities 8 containing said other row of receptacles. An extraction tool can be inserted into the recess for deflecting a latch portion 48 of a selected receptacle of said other row into the body of the receptacle to permit removal of the receptacle from its corresponding cavity 8.

In addition the recess 46 communicates between the rows of cavities 8 to permit an extraction tool to enter the recess 47, pass through a cavity 8 and into the recess 48 in order to deflect a latch portion of selected receptacle of the first row, permitting removal of the selected individual receptacle from the housing 2.

The first row of receptacles 6 are disposed closer to the end 16 of the housing than the other row of receptacles. This staggered row arrangement assures that the first row of receptacles will be received over a corresponding row of posts 32 before the other row of receptacles are received over the other corresponding row of posts 32. Such a feature divides the total insertion force required for mounting the receptacles collectively on the posts into smaller forces created sequentially and not in summation as the rows of receptacles are mounted over the corresponding rows of posts 32.

The mother board housing 34 is provided with pairs of slotted or notched openings 50 thereof to provide clearances for receipt of a tool which might be utilized to grip and remove the housing 2 from the mother board housing 34 if necessary.

Although a preferred embodiment of the present invention has been described in detail other embodiments and also modifications are intended to be covered by the spirit and scope of the apended claims.

What is claimed is:

1. A polarized connector, comprising:

a first connector housing mounted on a printed circuit board and having a plurality of pins therein, an opening in said first connector housing encircled by chamfered edges defining a funnel entry, a second connector housing having a plurality of receptacles therein for receiving in mating engagement said pins, said second connector housing being mounted on an edge margin of a printed circuit board, a lip on said second connector housing flush with one end thereof and covering an edge of said printed circuit board, said lip and said one end of said second connector housing being chamfered on the peripheral edges thereof for ease in insertion within said funnel entry, said pins being arranged in rows within said first connector housing offset toward a side of said first connector housing, said receptacles being arranged in rows within said second connector housing and including tail portions projecting therefrom for mounting within said printed circuit board, said receptacles being of different distances from said one end of said second connector housing, said pins being received through said one end of said second connector housing, and said receptacles being sequentially received over corresponding pins during insertion of said second connector housing in said first connector housing.

2. A polarized connector, comprising:

a first connector housing mounted on a printed circuit board and having a plurality of pins therein, an opening in said first connector housing encircled by chamfered edges defining a funnel entry, a second connector housing having a plurality of receptacles therein for receiving in mating engagement said pins, said second connector housing being mounted on an edge margin of a printed circuit board, a lip on said second connector housing flush with one end of said second connector housing and covering an edge of said printed circuit board, said lip and said one end being chamfered on the peripheral edges thereof for ease in insertion within said funnel entry, said pins being arranged in rows within said first connector housing offset toward a side of said first connector housing, said receptacles being arranged in rows within said second connector housing and including tail portions projecting therefrom for mounting within said printed circuit board, said second connector housing including a slotted opening communicating with the receptacles arranged in rows, and said second connector housing including a recess intersecting said receptacles of one of said rows, whereby an extraction tool may enter said recess and project into said slotted opening to deflect a portion of a selected receptacle and thereby allow removal thereof from said second connector housing.

* * * * *